United States Patent [19]

Kijima

[11] 4,352,081

[45] Sep. 28, 1982

[54] COMPACT TRANS CORE

[75] Inventor: Seiichi Kijima, Tokyo, Japan

[73] Assignee: Kijima Musen Kabushiki Kaisha, Tokyo, Japan

[21] Appl. No.: 199,642

[22] Filed: Oct. 22, 1980

[51] Int. Cl.[3] ..... H01F 27/24; H01F 27/30

[52] U.S. Cl. ..... 336/198; 336/212; 336/227; 336/233

[58] Field of Search ..... 336/83, 221, 212, 225, 336/227, 228, 233, 198

[56] References Cited

U.S. PATENT DOCUMENTS

| | | | |
|---|---|---|---|
| 2,585,050 | 2/1952 | Simon | 336/212 X |
| 2,925,540 | 2/1960 | Cox | 336/225 NR |
| 3,007,125 | 10/1961 | Furbee | 336/221 |
| 3,068,436 | 12/1962 | Holmberg et al. | 336/221 X |
| 3,332,049 | 7/1967 | Hisano | 336/83 |

FOREIGN PATENT DOCUMENTS

| | | | |
|---|---|---|---|
| 1563242 | 11/1969 | Fed. Rep. of Germany | 336/212 |
| 1504183 | 10/1967 | France | 336/212 |

*Primary Examiner*—Thomas J. Kozma
*Attorney, Agent, or Firm*—Finnegan, Henderson, Farabow, Garrett & Dunner

[57] ABSTRACT

A compact core for a transformer wherein the central leg of the core is either trapezoidal or triangular in cross-section and wherein the two side legs of the transformer core are triangular in cross-section. The selection of a trapezoidal or triangular central core leg and triangular side legs significantly reduces the overall dimensions of the transformer by constructing the side legs of the core so as to protrude into the space which would normally be immediately above or below the side legs of an E-E or E-I transformer.

3 Claims, 13 Drawing Figures

COMPACT TRANS CORE

FIELD OF THE INVENTION

This invention relates with particularity to the structure of a compact transformer core.

BACKGROUND OF THE INVENTION

It has been known to employ a transformer in various devices such as flash discharge lamps, photographic cameras, lighting equipment, and general electric communications systems. Because many of these devices are small, there has been a continual effort to reduce the overall dimensions of the transformers used therein without reducing the electrical capabilities of the transformer. Some of this effort has centered on reducing the size of the transformer core as a means of reducing the size of the transformer.

Prior art transformer have generally been of the E—E core configuration type as illustrated in FIG. 1(*a*), or the E-I configuration illustrated in FIG. 2(*a*). These core configurations have coils wound thereon as illustrated in FIG. 1(*b*) and FIG. 2(*b*), respectively.

The overall size of the transformer depends to a large extent upon the length and the width of the core 1 and, as stated, there have been attempts to reduce the dimensions of the transformer by reducing the dimensions of the core 1. It has been found, however, that such redesign is not without limits because a material reduction in the dimensions of the core 1 significantly affects its mechanical strength and can result in cores which do not contain a sufficient amount of iron to exhibit the proper electrical properties.

Specifically, excessive reduction of the core legs in their cross-section, particularly in the cross-section of the side legs 1*a*, 1*b*, often leads to damage to the core 1 in the course of manufacturing, or to the transformer as a whole because the core 1 is made of ferrite having a high magnetic permeability. For these reasons, it is customary to limit the cross-section of the core in commercial products to a range between 5.76 $mm^2$ and 8.82 $mm^2$.

Referring again to FIGS. 1(*a*) and 2(*a*) the central leg 1*c* is commonly formed to have a cross-section twice as large as the cross-section of each of the side legs 1*a*, 1*b*, and sufficient spacing must be provided between the central leg 1*c* and the side legs 1*a*, 1*b* to provide space for the core winding. Moreover, the requirement that the central leg 1*c* include at least a specific amount of iron in order to enable the desired output from the transformer places a distinct limit on the amount that the cross-section of the central leg 1*c* can be reduced.

SUMMARY OF THE INVENTION

It is an object of the present invention to provide a transformer that is significantly reduced in size but does not suffer any loss of its operational efficiency.

Still another object of this invention is to provide a transformer wherein the shape of the core is designed to minimize the size of the core while maintaining the same volume of ferrite material and the same electrical characteristics.

To achieve the foregoing objects in accordance with the invention, as embodied and broadly described herein, a core for a transformer comprises a central core leg having a base with opposite edges and at least first and second planar side members, each of the side members intersecting a different one of the edges of the base at an angle of less than 90°, a first core side leg having a first planar surface closely spaced from and parallel to the first planar side member and a second core side leg having a second planar surface closely spaced from and parallel to the second planar side member.

In one embodiment, the first and second planar side members intersect the edges of the base and together with a top member parallel to the base form a trapezoid. In another embodiment, the first and second side members intersect the edges of the base member to form a triangle.

BRIEF DESCRIPTION OF THE DRAWINGS

The manner in which the apparatus of the present invention is constructed and its mode of operation can best be understood in light of the following detailed description, together with the accompanying drawings, in which:

FIGS. 1(*b*) and 2(*b*) are cross-sectional views of the transformer cores illustrated in FIGS. 1(*a*) and 2(*a*), taken along the lines 1(*a*)–1(*b*) and 2(*a*)–2(*b*), respectively;

FIG. 6(*b*) is a cross-sectional view of the transformer core of FIG. 5 taken along the line 6*b*–6*b*;

DETAILED DESCRIPTION OF THE PREFERRED EMBODIMENT

Figure 3:
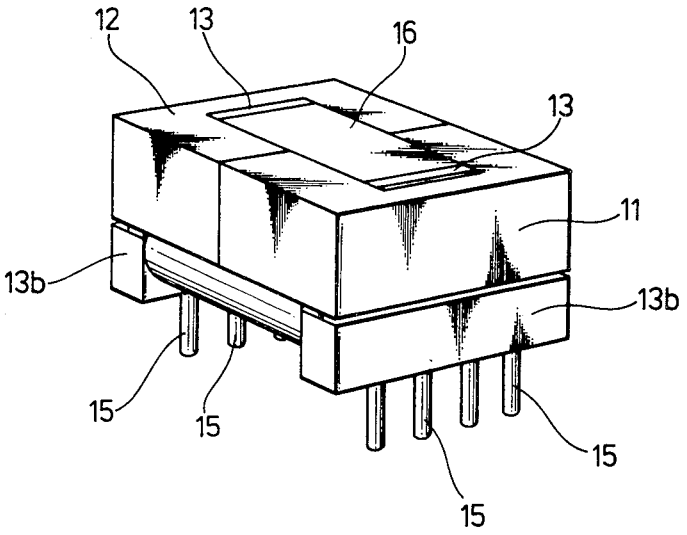
FIG. 3 is a perspective view of a transformer utilizing a core constructed according to the present invention.

FIG. 3 illustrates a perspective view of a transformer constructed according to the teachings of the instant invention. The transformer is comprised of a first transformer section 11 and a second transformer section 12 constructed as mirror images of each other. The transformer sections 11 and 12 together comprise the core of the transformer and are made of ferrite with a high magnetic permeability. A trapezoidal bobbin 13 is provided with a central trapezoidal aperture 13*a* (FIG. 5) extending through its length. The trapezoidal opening 13*a* receives the central legs 11*c* and 12*c* of the transformer sections 11 and 12, respectively. A coil 14 is wound around the bobbin 13 and a thin layer of insulating material 16 covers the upper and lower surfaces 16 (FIG. 4) of the coil 14. If desired, a feedback coil could also be wound around the bobbin 13.

Terminal pins 15 are received in enlarged portions 13*b* of the bobbin 13. These terminal pins 15 have affixed thereto the opposite ends of the coil 14 by means such as soldering. The insulating material 16 can comprise insulator tape or the like and be provided as the use of the transformer necessitates.

Figure 6A:
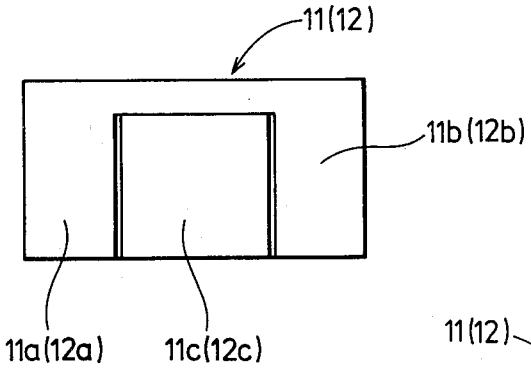
FIG. 6(*a*) is a cross-sectional view of the transformer of FIG. 3 taken along the line 6*a*—6*a*.
Figure 6B:
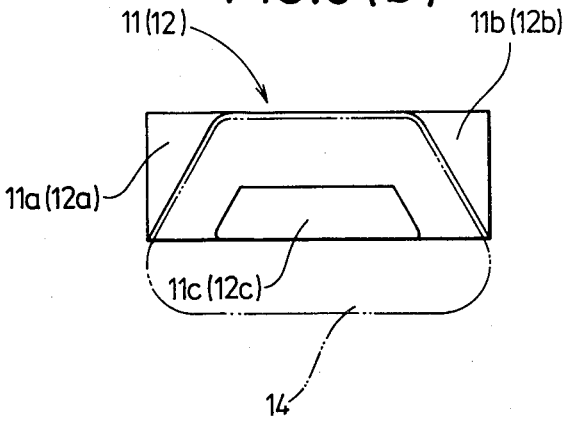

The core sections 11 and 12 are illustrated in detail in FIGS. 6*a* and 6*b*. FIG. 6*a* illustrates the side legs 11*a* and 11*b* of core section 11 of the transformer and the central leg 11*c* provided between the side legs 11*a* and 11*b*. The core section 12 is constructed as a mirror image of section 11 and only the core section 11 will be described in further detail.

As illustrated in FIG. 6*b*, the cross-section of the side legs 11*a* and 11*b* is substantially triangular. The central core leg 11*c* includes a planar base member 11*g* having two angular planar side members 11*h* and 11*i* intersecting the edges of the base 11*g* at equal angles less than 90°. In the embodiment of FIG. 6(*b*) a top member 11*j* is joined to the edges of the planar side members 11*h*, 11*i* such that the cross-section of the central core leg 11*c* is substantially trapezoidal.

The side legs 11*a* and 11*b* are disposed with respect to the central leg 11*c* such that respective angularly inclined surfaces of the central leg 11*c* extend substantially parallel to the opposed inner surfaces 11*d*, 11*e* of the side legs 11*a* and 11*b*, respectively.

Figure 4:
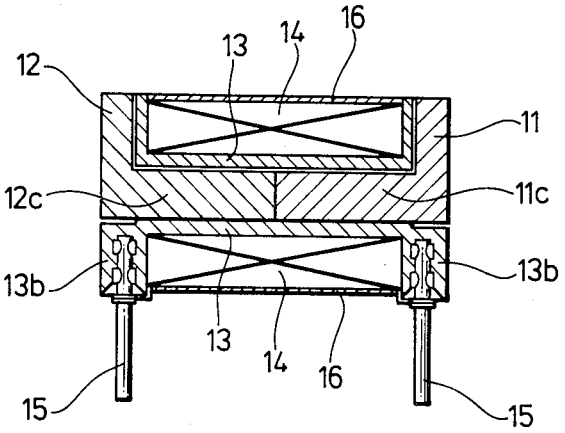
FIG. 4 is a cross-sectional view of the transformer of FIG. 3 taken along the line 4–4.
Figure 5:
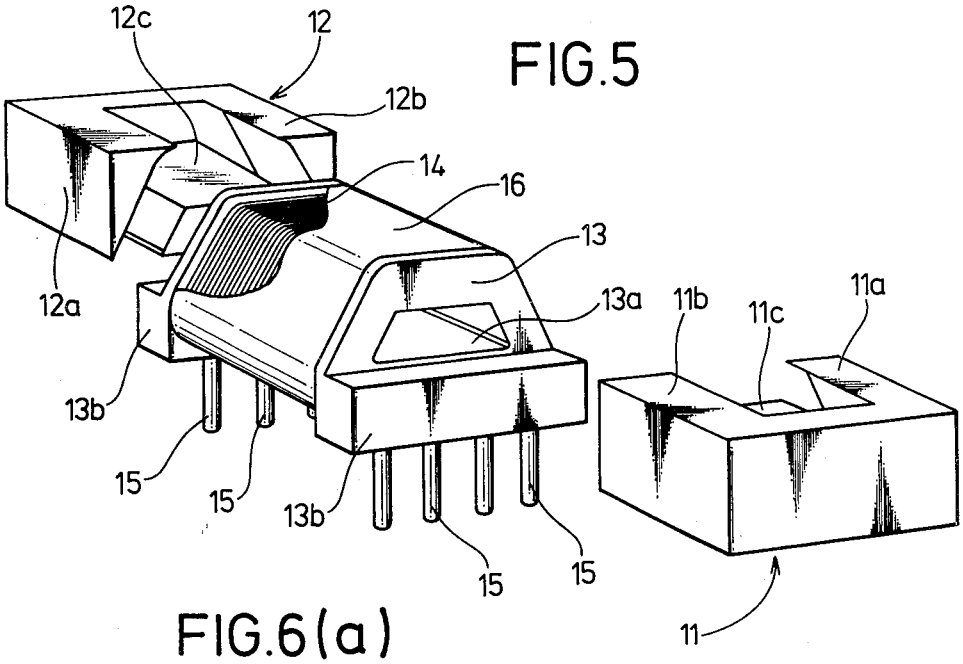
FIG. 5 is an exploded perspective view of the transformer of FIG. 3.

As illustrated in FIGS. 4 and 5 the sections 11, 12 of the core are abutted together by inserting the central legs 11*c* and 12*c* into the central opening 13*a* of the bobbin 13 from opposite sides. The corresponding side legs 11*a*, 12*a* and 11*b*, 12*b*, and the central legs 11*c*, 12*c* of the sections 11, 12 of the core are fixed together by suitable adhesive or other means to form the core of the transformer.

Figure 1A:
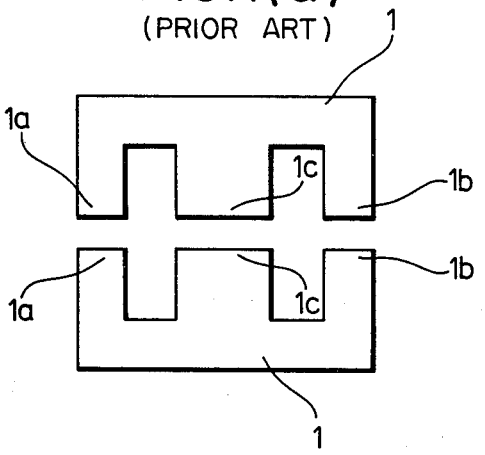
FIG.1(a) (PRIOR ART)
FIGS. 1(*a*) and 2(*a*) are plan views illustrating transformer cores of prior art devices.
Figure 2A:
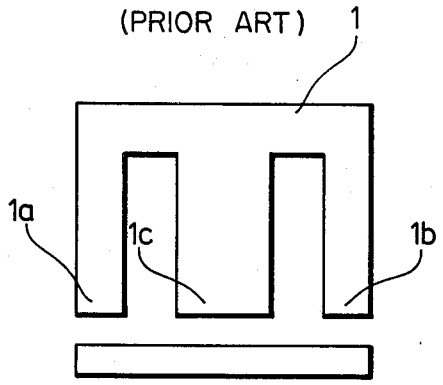
FIG.2(a) (PRIOR ART)
Figure 2B:
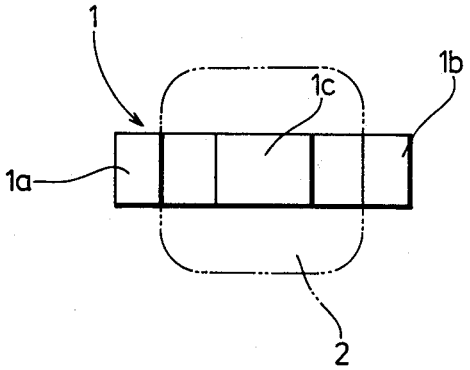
FIG.2(b) (PRIOR ART)
Figure 7:
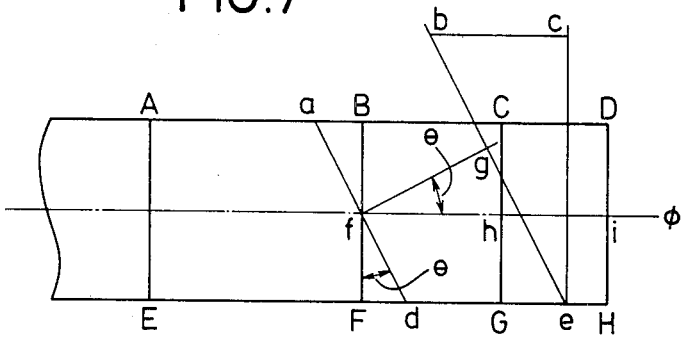
FIG. 7 is a schematic illustration of the principle of the transformer core construction of the instant invention compared to the construction of the prior art transformer cores.

FIG. 7 illustrates how a transformer constructed according to the above teachings is reduced significantly in dimensions with respect to prior art transformers including cores as illustrated in FIGS. 1*a* and 2*a*. Referring to FIG. 7, the area enclosed by connecting the points A, B, F, E corresponds to the cross-section of the central core leg 1*c* and the area enclosed by connecting the points C, D, H, G corresponds to the cross-section of side leg 1*b* of a conventional core 1 as illustrated in FIGS. 1*a* and 2*a*. A line $\phi$ marks the midpoint of the above-identified areas and establishes the relationships BF=Ff, CH=Gh and Di=Hi. The points f, h, and i represent points at which the side of the respective legs 1*b*, 1*c* intersect the center line $\phi$.

Assuming that a line ad passes through the point f at an angle $\theta$, $\Delta faB = \Delta fdF$ and it is possible to form a central leg 1*c* with a trapezoidal cross-section such that the area of the cross-section of the central leg 1*c* is equal to the total cross-sectional area of the side legs 1*a*, 1*b*.

As illustrated, the line fg extends from the intersecting point f at an angle $\theta$ such that fg=fh. A straight line be passing through point g extends parallel to the line ad. The line ce extends perpendicular to the line EH at a point e and a straight line bc extends parallel to the line AD at a point selected so that $\Delta bce$ has a cross-sectional area equal to the area defined by the points CDHG. In this manner, a right leg 11*b* can be formed having a cross-sectional shape corresponding to $\Delta bce$ and a cross-sectional area corresponding to the cross-sectional area of the side leg 1*b* as employed in the prior art cores.

Because of the relationship fg=fh, the spacing required for winding the coil around the core remains unchanged even after the cross-sectional shape of the side legs is changed to be triangular. The width of the core for the side leg 1*b* is reduced by the amount eH since a portion of the core side 11*b* now extends above what was previously the upper surface of the core side leg 1*b*. Since there are two side legs 1*a*, 1*b*, the overall core width will be reduced by an amount 2eH. The value of eH, reflecting one-half of the net decrease in the width of core, is given by $$eH = FH - fh \cos\theta - (fh \sin\theta + fF) \tan\theta.$$

As an example of the core configuration, the geometric relationships of fF=x, fh=x, hi=x, and FH=2x are set and eH is set equal to zero. Neglecting the cases where $\theta = 90°$ and $\theta x = \text{zero}°$, the value for $\theta$ is defined by $$\theta = \cos^{-1} 0.8 = 36.87° \text{ as obtained from the formula}$$

$$eH = 2x - x \cos\theta - (x \sin\theta + x) \tan\theta = 0.$$

Accordingly, the core width can be reduced where $\theta$ is 36.87° or less.

Figure 1B:
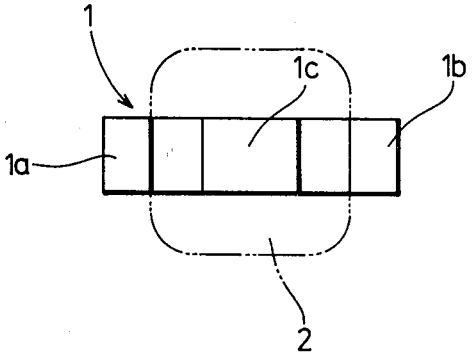
FIG.1(b) (PRIOR ART)

Applying these calculations to the illustrated physical embodiment of the invention, when the core sections 11, 12 are formed according to the present invention, the side leg 11*b* includes a portion, defined by the area enclosed within b, $b_1$, c, $c_1$, protruding upward (as best seen in FIG. 7) which corresponds to a space that would have been immediately above the side leg 1*b* as shown in FIG. 1(*b*). Furthermore, the coil 14 when wound around the core sections 11, 12 protrudes, as seen from FIG. 6(*b*), into the space defined by connecting the points $d_1$, $d_2$, $d_3$ immediately below the side leg 1*b*. The side legs 11*a*, 12*a*, 12*b* protrude in a similar manner when compared to the core structure of the prior art and, similarly, the coil extends below the core side legs 11*a*, 12*a*, 12*b*. These spaces were not previously employed for the construction of prior art transformers, and it is by utilizing these spaces that the constructions of the instant invention are smaller than prior art core constructions.

Figure 8:
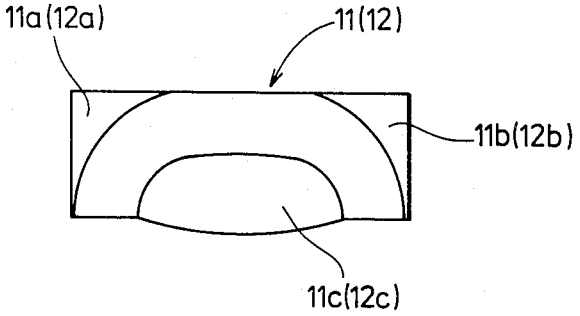
FIG. 8 is a cross-sectional view of an alternate embodiment of the transfromer core constructed according to the present invention.

When the central legs 11*c*, 12*c* of the core are configurated so as to be substantially trapezoidal in cross-section, each central leg has its outer peripheral surface defined by four planes and, as a result, the coil 14 wound there around swells outwardly. A depressive force exerted thereon intending to bring the coil into close contact with the surfaces of the central leg would adversely influence the electrical properties of the coil. To compensate for this, an alternate embodiment of the central legs 11*c* and 12*c* and the side legs 11*a*, 11*b*, 12*a*, and 12*b* can be provided. In this embodiment (FIGS. 5 and 8), the surfaces of the central legs 11*c* and 12*c* are slightly curved convexly and the inner surfaces 11*d*, 11*e*, 12*d*, 12*e* of the side legs 11*a*, 11*b*, 12*a*, 12*b*, respectively, are formed concavely so that the convex and concave portions complement themselves as illustrated in FIG. 8.

Figure 9:
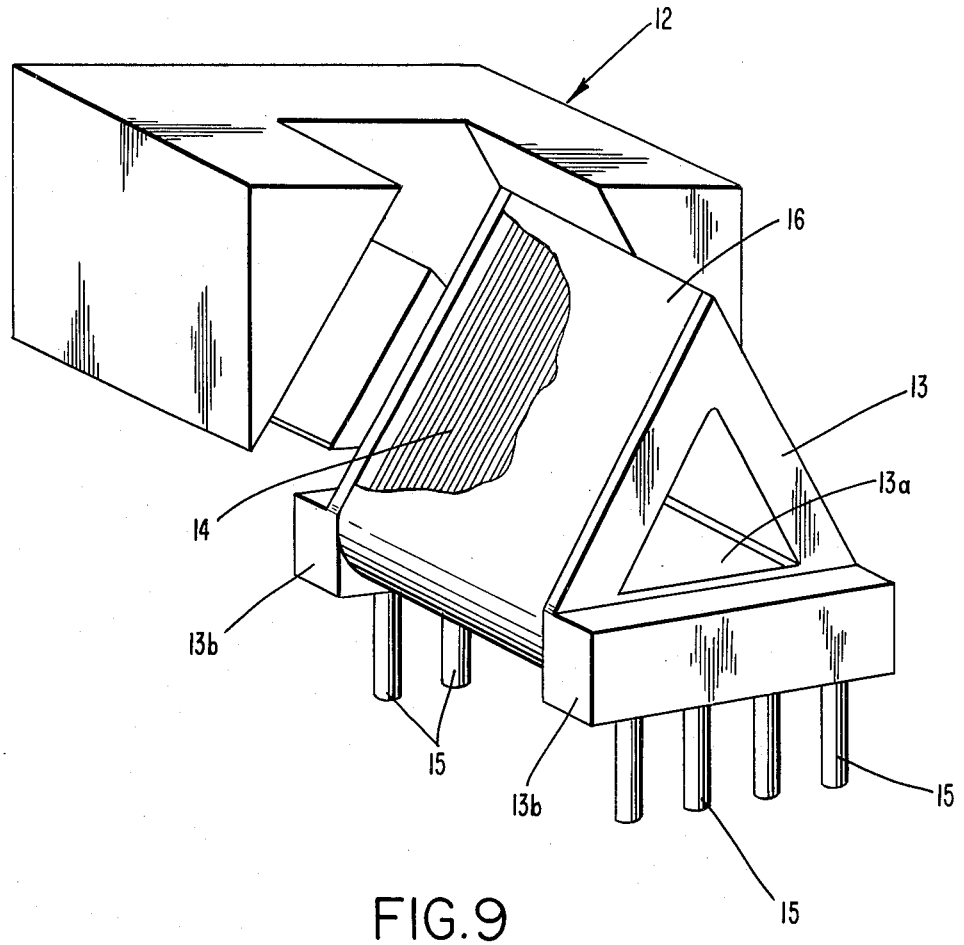
FIG. 9 is an exploded view of an alternate embodiment of the transformer core of the present invention.

In accordance with the present invention, planar side members 11*h*, 11*i* may intersect the base 11*g* of the central core leg such that the central core leg 11*c* has a triangular cross-section to provide the same effect as obtained from the above-mentioned trapezoidal construction. The triangular cross-section of the central core leg 11*c* is isosceles so that symmetry can be maintained. In such constructions, the central aperture 13*a* of the bobbin 13 also has a triangular cross-section. This embodiment is illustrated in FIG. 9.

Figure 10:
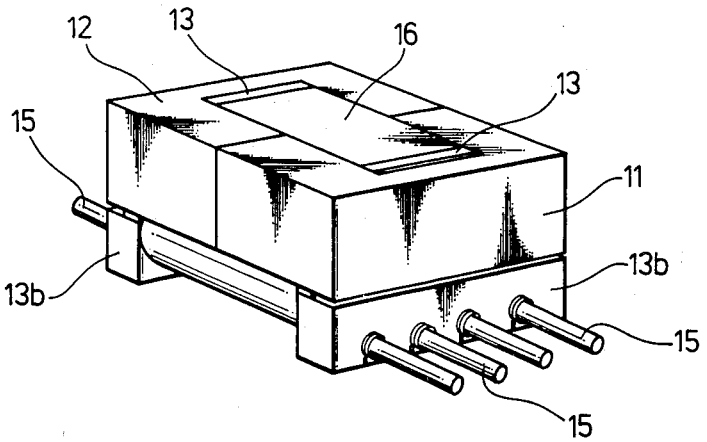
FIG. 10 is a perspective view of an alternate embodiment of a transformer core constructed according to the teachings of the instant invention.

FIG. 10 illustrates an embodiment of the invention wherein the terminal pins 15 project laterally from the transformer instead of projecting vertically.

It will be apparent, to those skilled in the art, that modifications and variations can be made in the preferred and alternate embodiments disclosed herein without departing from the scope or the spirit of the invention. Thus, it is intended that the present invention include such modifications and variations which come within the scope of the appended claims and their equivalents.

What is claimed is:

1. A transformer comprising:

a core including;

a substantially trapezoidal central core leg having a base with opposite edges and first and second planar side members, each said side member intersecting a different one of said edges of said base at an angle less than 90°;

a first core side leg having a first planar surface closely spaced to and in parallel with said first planar side member; and a second core side leg having a second planar surface closely spaced to and in parallel with said second planar side member; and a bobbin member receiving a core winding, said bobbin member having a first end, a second end, and a trapezoidal cross-section and including a trapezoidal central aperture extending through the length of said bobbin member from said first end to said second end, said central trapezoidal aperture receiving said trapezoidal central core leg, said bobbin member separating said first and second planar side members of said central core leg from said first planar surface of said first core side leg and said second planar surface of said second core side leg said bobbin member further including a first enlarged terminal block member at said first end and a second enlarged terminal block member at said second end, each of said enlarged terminal block members receiving a plurality of spaced apart terminal pins interconnected with said core winding and having exterior lateral surfaces and a bottom surface coextensive with the exterior lateral surfaces of said core and the exterior bottom surface of said core winding, respectively.

2. A transformer according to claim 1 wherein said first core side leg and said second core side leg are each triangular in cross-section.

3. A transformer according to claim 2 wherein said first planar surface and said second planar surface comprise the hypotenuse of said triangular first core leg and said second core leg, respectively.

* * * * *